US008621703B2

(12) United States Patent
Delaere et al.

(10) Patent No.: US 8,621,703 B2
(45) Date of Patent: Jan. 7, 2014

(54) BRUSH FOR A MACHINE FOR THE HORIZONTAL AND/OR VERTICAL CLEANING OF SURFACE THAT ARE SEPARATED BY GROOVES, JOINTS, UNEVENNESSES AND/OR PORES AND A MACHINE PROVIDED WITH SUCH BRUSHES

(76) Inventors: Marc Delaere, Lochristi (BE); Christiaan De Clerck, Lochristi (BE)

( * ) Notice: Subject to any disclaimer, the term of this patent is extended or adjusted under 35 U.S.C. 154(b) by 228 days.

(21) Appl. No.: 13/000,429

(22) PCT Filed: Jul. 7, 2009

(86) PCT No.: PCT/IB2009/006184

§ 371 (c)(1),
(2), (4) Date: Dec. 21, 2010

(87) PCT Pub. No.: WO2010/004407

PCT Pub. Date: Jan. 14, 2010

(65) Prior Publication Data

US 2011/0107530 A1 May 12, 2011

(30) Foreign Application Priority Data

Jul. 7, 2008 (BE) ..... 2008/0376

(51) Int. Cl.
*A46B 13/00* (2006.01)

(52) U.S. Cl.
USPC ..... 15/180; 15/50.1; 15/202

(58) Field of Classification Search
USPC ..... 15/87, 50.1, 49.1, 28, 202, 201, 198, 15/194, 191.1, 190, 180, 179, 183
See application file for complete search history.

(56) References Cited

U.S. PATENT DOCUMENTS

| | | | | |
|---|---|---|---|---|
| 1,391,882 | A * | 9/1921 | Dworniczak | 15/180 |
| 2,480,739 | A * | 8/1949 | Johnson | 15/28 |
| 2,668,711 | A * | 2/1954 | McLaughlin | 473/278 |
| 3,050,763 | A * | 8/1962 | Martin | 15/197 |

(Continued)

FOREIGN PATENT DOCUMENTS

| | | | |
|---|---|---|---|
| DE | 202004012695 | U1 * | 12/2004 |
| EP | 1623652 | A | 2/2006 |
| WO | 2004086905 | A | 10/2004 |
| WO | WO 2007132335 | A2 * | 11/2007 |

OTHER PUBLICATIONS

International Search Report from ISA/EPO dated May 27, 2010.

*Primary Examiner* — Lee D Wilson
*Assistant Examiner* — Tyrone V Hall, Jr.
(74) *Attorney, Agent, or Firm* — Symbus Law Group, LLC; Clifford D. Hyra

(57) ABSTRACT

A brush for a machine for the horizontal and/or vertical cleaning of surfaces which are provided with grooves, joints, unevennesses and/or pores is provided to move the brush in a plane which is substantially parallel to a surface. This brush is provided with at least one set of first hairs for cleaning or polishing the parts of the surface which extend between the grooves, joints, unevennesses and/or pores, and at least one set of second hairs for cleaning the grooves, joints, unevennesses and/or pores.

The brush includes a base plate which is releasably attached to one or several brush parts, which are provided with one or several sets of second hairs. A machine for the horizontal and/or vertical cleaning of surfaces which are provided with grooves, joints, unevennesses and/or pores is provided with one or several of such brushes.

20 Claims, 4 Drawing Sheets

(56) References Cited

U.S. PATENT DOCUMENTS

| | | | | | |
|---|---|---|---|---|---|
| 3,181,193 | A | * | 5/1965 | Nobles et al. | 15/114 |
| 3,233,272 | A | * | 2/1966 | Pambello | 15/182 |
| 3,678,530 | A | * | 7/1972 | Horton et al. | 15/180 |
| 4,037,369 | A | * | 7/1977 | Campbell | 451/532 |
| 4,138,804 | A | * | 2/1979 | Thielen | 451/342 |
| 4,236,269 | A | * | 12/1980 | Block | 15/180 |
| 4,480,351 | A | * | 11/1984 | Koffler | 15/187 |
| 4,998,314 | A | * | 3/1991 | Borofsky | 15/4 |
| 5,249,325 | A | * | 10/1993 | Wilen | 15/4 |
| 5,522,110 | A | * | 6/1996 | Borofsky | 15/116.2 |
| 5,584,091 | A | * | 12/1996 | Borofsky | 15/115 |
| 5,664,278 | A | * | 9/1997 | Reisman | 15/160 |
| 6,134,740 | A | * | 10/2000 | Torres et al. | 15/180 |
| 6,665,902 | B1 | * | 12/2003 | Vegter | 15/183 |
| 7,203,987 | B2 | * | 4/2007 | Kuivikko et al. | 15/87 |
| 2007/0136970 | A1 | * | 6/2007 | Hettes | 15/180 |
| 2009/0083925 | A1 | * | 4/2009 | Mathiez | 15/207.2 |

* cited by examiner

BRUSH FOR A MACHINE FOR THE HORIZONTAL AND/OR VERTICAL CLEANING OF SURFACE THAT ARE SEPARATED BY GROOVES, JOINTS, UNEVENNESSES AND/OR PORES AND A MACHINE PROVIDED WITH SUCH BRUSHES

This application claims the benefit of Belgian patent application No. 2008/0376, filed Jul. 7, 2008, which is hereby incorporated by reference in its entirety.

BACKGROUND

With a machine for the vertical and/or horizontal cleaning of clinkers, cobblestones, natural stone, tiles, brick, external plaster, etc. inter alia, scrubbing, sweeping and/or polishing machines are meant. These can be driven by electrical, hydraulic, pneumatic or similar means.

Surfaces which are provided with grooves, joints, unevennesses and/or pores are, inter alia, clinkers, cobblestones, natural stone, tiles, brick, external plaster, road pavement (VPA=very porous asphalt and VPAC=very porous asphalt concrete), and/or metal and/or wood.

Concerning the cleaning of several surfaces which are separated by grooves, joints, unevennesses and/or pores, it is known to use high-pressure cleaning or cleaning with chemical products. Therewith, said surfaces are hosed down by means of a water jet, sandblast and/or water-sand jet under high pressure (from 120 bar). In the case of chemical cleaning, chemical products are applied to said surfaces. The chemical products act on the dirt which is present. After a soak-in period, any dirt which is present and the chemical products are sprayed away.

However, there are several drawbacks associated with high-pressure and chemical cleaning, i.e.

- the grooves, joints, unevennesses and/or pores between the surfaces are not deep-cleaned;
- the several surfaces which are separated from one another by means of grooves, joints, unevennesses and/or pores are often damaged by the high-pressure force of the water and/or the sand;
- large amounts of water are required;
- in some cases, a large amount of cleaning products have to be used;
- the water and sand splashes, as a result of which surfaces surrounding the surface to be cleaned, such as, inter alia, walls and/or windows, are soiled;
- high-pressure cleaning is labour-intensive. Thus, it takes on average 8 hours to clean a surface of approximately 100 $m^2$ consisting of clinkers, cobblestones, natural stone and/or tiles. This includes introducing new sand in the grooves, joints, unevennesses and/or pores when required, and includes cleaning the surrounding soiled surfaces;
- after cleaning with high pressure, the clinkers, cobblestones, etc. become loose, as a result of which it takes a long time before one can drive over the cleaned surface again;
- stubborn dirt, such as, inter alia, lichens, are difficult to remove by high-pressure cleaning;
- the noise pollution caused by the high-pressure cleaner;
- the chemical products are detrimental to the surface consisting of clinkers, natural stone, tiles, brick, external plaster, metal and/or wood;
- the chemical products are harmful to the environment: humans, animals and plants. A European decree (becoming effective in 2012) prohibits the further use of herbicides by municipalities, cities and government bodies to combat weeds on car parks, cycling paths and footpaths and the like.

This problem has already been solved by BE 1 017 134, which discloses a brush for a scrubbing, sweeping and/or polishing machine for machine-cleaning of several surfaces which are separated from one another by means of grooves and/or joints, wherein this scrubbing, sweeping and polishing machine is provided with one or several brushes which comprise at least one set of polishing hairs for cleaning and/or polishing the surfaces, and at least one set of joint hairs for cleaning the grooves and/or the joints between the surfaces, wherein the polishing hairs have a length which is shorter than the length of the joint hairs, and which discloses a machine which is provided with one or several of such brushes.

A drawback of this brush is that the joint hairs wear and become as short as the polishing hairs of the brush, as a result of which it is no longer possible to clean grooves, joints, unevennesses and/or pores using this brush. A drawback of the wear of the joint hairs is the fact that the brush no longer moves in the vertical direction, as a result of which surfaces are cleaned less efficiently. A further drawback of such a brush is the fact that different brushes are required for different surfaces and/or different kinds of soiling in order to achieve efficient cleaning. For the efficient cleaning of cobblestones, for example, the brush needs to contain more steel hairs than are required for the efficient cleaning of natural stone. Thus, these two different surfaces require two different brushes.

SUMMARY

As a consequence, it is the object of the invention to provide a brush for the horizontal and/or vertical cleaning of surfaces which are provided with grooves, joints, unevennesses and/or pores, and a machine provided with one or several of such brushes, wherein the abovementioned drawbacks are overcome, and wherein therefore a brush is provided which does not have to be replaced in each case when the joint hairs are worn, or for cleaning of different surfaces.

The invention relates to a brush for a maching for the horizontal and/or vertical cleaning of surfaces which are provided with grooves, joints, unevennesses and/or pores, wherein said machine is provided to move the brush in a plane which is substantially parallel to said surface, and wherein this brush is provided with

- at least one set of first hairs for cleaning or polishing the parts of the surface which extend between the grooves, joints, unevennesses and/or pores,
- at least one set of second hairs for cleaning the grooves, joints, unevennesses and/or pores;

wherein these first and second hairs form a cleaning surface and wherein these second hairs protrude with respect to the first hairs at this cleaning surface.

Furthermore, the invention relates to a machine for the horizontal and/or vertical cleaning or surfaces which are provided with grooves, joints, unevennesses and/or pores, provided with one or several of such brushes.

On the one hand, the object of the invention is solved by providing a brush for a machine for the horizontal and/or vertical cleaning of surfaces which are provided with grooves, joints, unevennesses and/or pores, wherein said machine is provided to move the brush in a plane which is substantially parallel to said surface, and wherein this brush is provided with at least one set of first hairs for cleaning or polishing the parts of the surface which extend between the grooves, joints, unevennesses and/or pores, at least one set of second hairs for cleaning the grooves, joints, unevennesses and/or pores;

wherein these first and second hairs form a cleaning surface and wherein these second hairs protrude with respect to the first hairs at this cleaning surface, and wherein the brush comprises a base plate which is provided to be releasably connected by means of one or several bolt or screw connections to one or several brush parts which are provided with one or several sets of second hairs. Such a brush is also referred to as a modular brush.

Screws with a threaded end which are of the same diameter along their entire length are screwed into nuts or tapped holes, while screws with a pointed end are screwed directly into the material to be attached. If the tightening force is exerted on the exterior of the head, the screws are referred to as bolts.

By providing such a modular brush with modular brush parts, the flexibility, the efficiency and the usability of the brush is increased:

by using a base plate with implanted first hairs for cleaning or polishing the parts of the surface which extend between the grooves, joints, unevennesses and/or pores and different brush parts with and without implanted second hairs for cleaning the grooves, joints, unevennesses and/or pores, it is possible to produce brushes where the length of these first and second hairs is different;

since it is possible to attach modular brush parts with one type of implanted second hairs on a base plate with implanted first hairs. The material of the implanted second hairs on the modular brush part can vary and for example consist of plastic or metal. With one round brush base plate, several brush types can be produced by changing the modular brush parts with the implanted second hairs. Brushes can be produced for different types of surfaces and/or types of soiling and with in each case different cleaning properties.

since modular brush parts with different types of implanted second hairs can be attached to a round brush base plate with implanted first hairs.

the desired and required difference in length between the polishing hairs and the joint hairs is obtained in a quick and efficient manner after the joint hairs have been shortened as a result of wear. This difference in length can be achieved, inter alia, by placing a new modular brush part between the base plate and the modular brush part with implanted joint hairs.

This brush furthermore has the advantage that:

the difference in length between the first hairs for cleaning or polishing the parts of the surface which extend between the grooves, joints, unevennesses and/or pores and the second hairs for cleaning the grooves, joints, unevennesses and/or pores, causes the brush to also move in the "vertical direction" with respect to the surface to be cleaned, as a result of which the stubborn dirt on the surface of clinkers, cobblestones, natural stone, tiles, brick, external plaster, road pavement (VPA, VPAC) and/or metal and/or wood, is loosened and removed more efficiently. This makes it possible, for example, to remove rubber from clinkers and/or polished concrete in a very simple manner.

by creating various differences in length between the first and second hairs in one round brush base plate, the "vertical movement" of the brush can be influenced;

the grooves, joints, unevennesses, pores and/or sides of the clinkers, cobblestones, natural stone, tiles, brick, external plaster, road pavement (VPA, VPAC) and/or metal and/or wood, are thoroughly cleaned up to a predetermined depth;

the several surfaces which are separated from one another by means of grooves, joints, unevennesses and/or pores are not damaged during the cleaning process;

the grooves, joints, unevennesses and/or pores are deep-cleaned, as a result of which mosses, grasses, paint and other dirt are removed;

the cleaning process requires little water;

there is a limited use of cleaning products and chemical products;

there is no splashing water and/or sand, as a result of which interior and external walls and/or windows surrounding the surfaces to be cleaned are not soiled;

if the modular brush is attached to the machine, this machine can be handled very well due to the presence of the relatively long hairs, and additional pressure can be exerted on these relatively long hairs which provide additional cleaning;

the time required for cleaning is much shorter, i.e. approximately three and a half work hours for 100 $m^2$ (including introducing new sand into the grooves, joints, unevennesses and/or pores—should this be necessary—and including cleaning of the surrounding soiled surfaces);

by providing metal hairs and/or due to the irregular (abrasive) surface of plastic hairs, it is possible to remove even stubborn soiling, such as mosses, lichens, paints (inter alia graffiti), cement veil and oils, as a result of which the appearance of the surface and the safety, for example the risk of slipping, are improved.

To this end, preferably one or several intermediate pieces are provided which can be mounted between the base plate and said brush part.

In a particular embodiment of a brush according to the invention, said base plate, brush parts and intermediate pieces are provided with one or several openings which extend through the thickness of the base plate, brush parts and intermediate pieces in order to releasably connect the brush parts and the intermediate pieces to the base plate by means of a bolt or screw and nut connection.

In order to clean certain surfaces with grooves, joints, unevennesses and/or pores, it is sometimes necessary to have joint hairs of different lengths with respect to the base plate of the brush in order to clean these surfaces in an optimum and efficient manner. As a result, the second hairs of at least two of said brush parts can protrude over a different length with respect to said first hairs at the level of the cleaning surface.

Furthermore, it may sometimes also be necessary, depending on the type of surface, to provide said brush parts with different types of second hairs.

In a preferred embodiment of a brush according to the invention, said base plate therewith comprises two or several sets of first hairs which are directly implanted into the base plate, wherein there is a zone between two sets of first hairs which is free from said first hairs and which is provided for the attachment of said brush parts wherein said second hairs are implanted by means of one or several bolt or screw connections, optionally using nuts.

In an advantageous embodiment of a brush according to the invention, the zones which are provided for the attachment of said brush parts have a shape which is complementary to the shape of the zones wherein said two or several sets of first hairs extend.

In a preferred embodiment of a brush according to the invention, said brush parts are L-shaped. The expression L-shaped is understood to mean a shape wherein a brush part consists of a first brush part and a second brush part which is at right angles to the first brush part at an end thereof.

In a particular embodiment of a brush according to the invention, one or several intermediate pieces are provided which are provided to be mounted between the base plate and said brush part.

In a preferred embodiment of a brush according to the invention, the brush comprises 4 of said brush parts which are arranged in pairs in line with respect to one another in the assembled state of the brush.

In a more preferred embodiment of a brush according to the invention, the fictitious lines on which the brush parts are situated in the assembled state are at an angle of approximately 90°.

In an advantageous embodiment of a brush according to the invention, the base plate is of a round design.

Depending on the type of surface and the kind of soiling, different kinds of joint hairs on the brush parts on one and the same base plate may be necessary for efficient cleaning.

In a preferred embodiment of a brush according to the invention, the second hairs have a lower density (hairs/$cm^2$) than the first hairs.

In a particular embodiment of a brush according to the invention, the second hairs have a diameter which differs from the diameter of the first hairs.

In a preferred embodiment of a brush according to the invention, one or several first and/or second hairs have a smooth surface.

In a particular embodiment of a brush according to the invention, one or several first and/or second hairs have an irregular surface.

In a preferred embodiment of a brush according to the invention, the hairs are made from plastic and/or metal.

In an advantageous embodiment of a brush according to the invention, the cores of the first and/or second hairs are reinforced with reinforcing material.

In a more advantageous embodiment of a brush according to the invention, the cores of the first and/or second hairs are reinforced by means of metal wire or steel.

In a preferred embodiment of a brush according to the invention, the base plate, the brush parts and the intermediate pieces are made from plastic, preferably polypropylene.

On the other hand, the object of the invention is achieved by providing a machine for the horizontal and/or vertical cleaning of surfaces which are provided with grooves, joints, unevennesses and/or pores, wherein said machine is provided with one or several brushes which are moved in a plane which is substantially parallel to said surface, and wherein this brush is provided with

- at least one set of first hairs for cleaning or polishing the parts of the surface which extend between the grooves, joints, unevennesses and/or pores,
- at least one set of second hairs for cleaning the grooves, joints, unevennesses and/or pores;

wherein these first and second hairs form a cleaning surface and wherein these second hairs protrude with respect to the first hairs at this cleaning surface, and wherein the machine is provided with one or several brushes according to the invention as described above.

After treating the several surfaces, such as, inter alia, clinkers, cobblestones, natural stone, tiles, brick, external plaster, road pavement (VPA, VPAC) and/or metal and/or wood, which are separated from one another by means of grooves, joints, unevennesses and/or pores, with a machine (scrubbing, sweeping, polishing, pneumatic machine), all of the dirt which has come loose has to be sprayed away from the cleaned surface by means of an efficient spraying device.

BRIEF DESCRIPTION OF THE DRAWINGS

In order to further illustrate the features of this invention and to indicate additional advantages and particulars thereof, a more detailed description of various preferred embodiments of a brush according to the invention is given below. It will be clear that nothing in the following description can be interpreted as a limitation of the scope of protection claimed in the claims for the modular brush according to the invention.

Furthermore, some of these embodiments are described in the attached figures, wherein reference numerals are used to refer to these figures, wherein.

DETAILED DESCRIPTION

Figure 1:
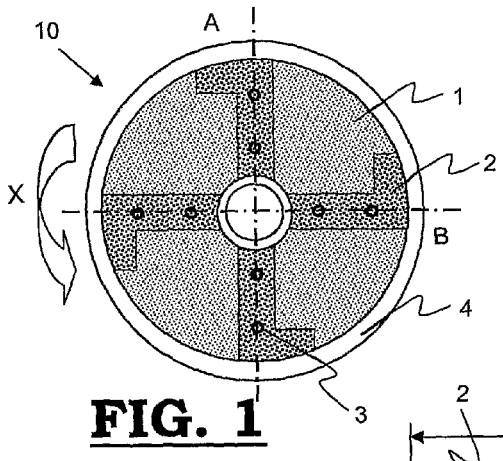
FIG. 1 shows a top view of a first embodiment of a modular brush for a machine for the horizontal and/or vertical cleaning of surfaces which are provided with grooves, joints, unevennesses and/or pores according to the invention.
Figure 2:
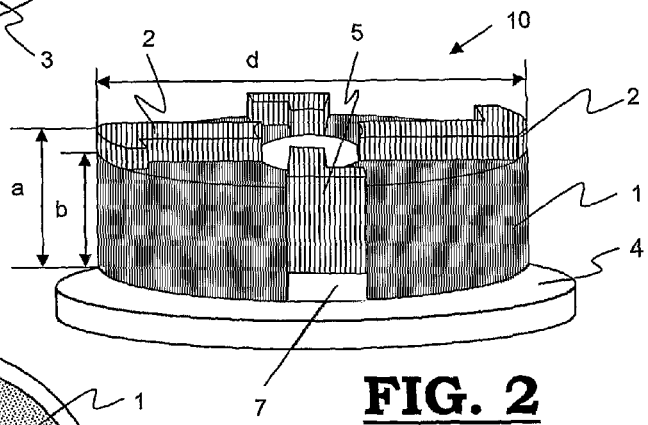
FIG. 2 shows a perspective front view of the first embodiment as illustrated in FIG. 1.
Figure 3:
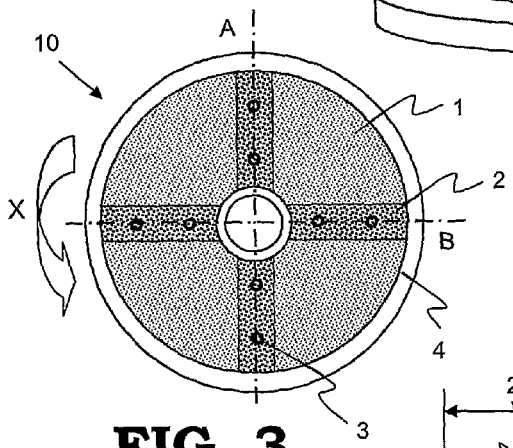
FIG. 3 shows a top view of a second embodiment of a modular brush for a machine for the horizontal and/or vertical cleaning of surfaces which are provided with grooves, joints, unevennesses and/or pores according to the invention.
Figure 4:
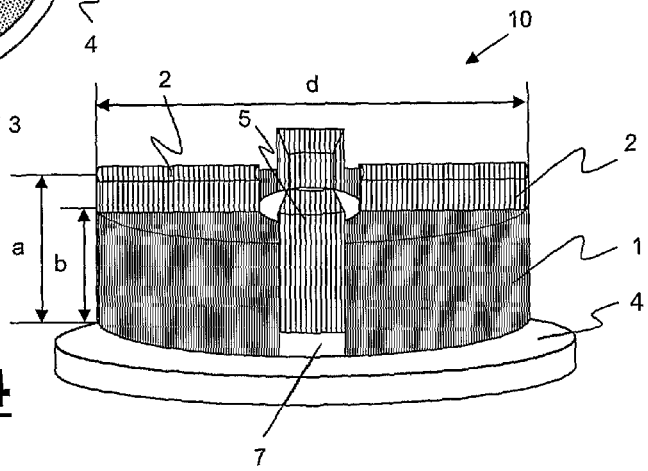
FIG. 4 shows a perspective front view of the second embodiment as illustrated in FIG. 3.

A modular brush (10) according to the invention, as illustrated in FIGS. 1 to 5 and 9 to 12, is provided to be mounted to a machine for machine-cleaning of several surfaces separated from one another by means of grooves, joints, unevennesses and/or pores, such as, inter alia, clinkers, cobblestones, natural stone, tiles, brick, external plaster, road pavement (VPA, VPAC) and/or metal and/or wood. One or several modular brushes (10) according to the invention can be mounted to such a machine. This machine is in this case provided to move these modular brushes (10) in a plane which is substantially parallel to said surfaces which are separated from one another.

Such a modular brush (10) comprises a preferably round base plate (4) which is provided with at least one set of first hairs (1) for cleaning or polishing the said surfaces which are directly implanted into this base plate (4). Furthermore, this modular brush (10) comprises one or several modular brush parts (5) (as can be seen in FIGS. 2, 4, 5, 10, 12, 15, 16, 17, 20, 21 and 22) which are provided to be releasably attached to said base plate (4) by means of one or several bolt or screw connections, and which are provided with one or several sets of second hairs (2) which are implanted in a modular base (7), with these second hairs (2) being provided for cleaning the grooves, joints, unevennesses and/or pores between said surfaces which are separated from one another.

These sets of first and second hairs (1, 2) therewith form a cleaning surface, with the second hairs (2) at this cleaning surface protruding with respect to the first hairs (1) in order thus to be able to clean grooves, joints, unevennesses and/or pores.

As can be seen in FIGS. 1 to 14, said base plate (4) preferably comprises two or several sets of first hairs (1) which are implanted directly into the base plate (4), with a zone (8) (see FIGS. 6, 7, 13 and 14) being present between two sets of first hairs (1) which is free from said first hairs (1) and which is intended for the attachment of said brush parts (5) into which said second hairs (2) are implanted.

As can be seen in FIGS. 1 to 14, the zones with first hairs (1) preferably have a shape which is complementary to the shape of the zones with second hairs (2).

In the preferred embodiments of a modular brush (10) according to the invention as illustrated in FIGS. 1 to 5 and 9 to 12, in the assembled state of the brush (10) 4 modular brush parts (5) are provided which are arranged in pairs in a line (fictitious lines A and B). In the preferred embodiments of a modular brush (10) according to the invention as illustrated in FIGS. 1 to 5, these two lines (A, B) are at a right angle to one another [in other words, these two lines (A, B) are at an angle of approximately 90° or these two lines (A, B) are perpendicular to one another], while with the preferred embodiments as illustrated in FIGS. 9 to 12, these two lines (A, B) are at a different angle to one another than a right angle or a zero angle.

As is illustrated in FIGS. 1, 2, 9, 10, 15 and 16, the modular brush parts (5) may be L-shaped, or in other words these may have an end with a brush part which is at right angles to the remainder of the modular brush part (5). The zones with first hairs (1) which are implanted directly into the base plate (4) preferably have a shape which is complementary to this L shape. However, the modular brush parts (5) can also have an elongate shape, as is illustrated in FIGS. 3 to 5, 11 and 12, 20, 21 and 22.

With regard to the abovementioned, it should be noted that it is also possible to provide more or fewer modular brush parts (5), that the modular brush parts (5) and/or the zones with first hairs (1) may have a different shape and that the first and second hairs (1, 2) may also be arranged in a different suitable configuration.

Figure 5:
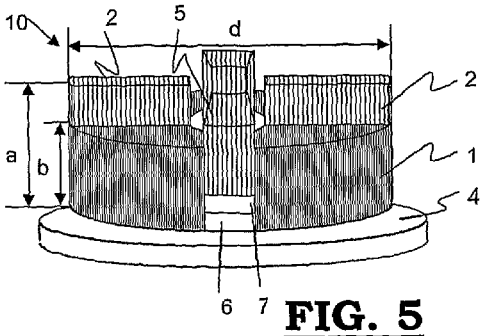
FIG. 5 shows a perspective front view of the second embodiment as illustrated in FIGS. 3 and 4, wherein an intermediate piece is mounted between the bases of the modular brush parts and the base plate of the brush.
Figure 5A:
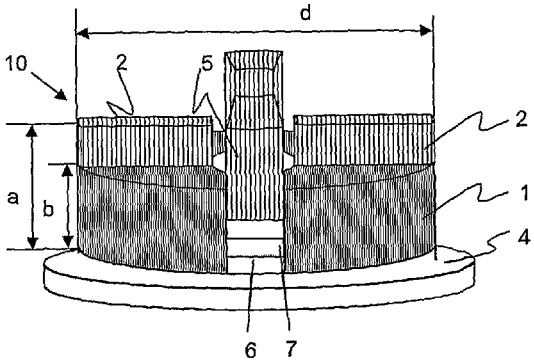
FIG. 5A shows a perspective front view of the second embodiment as illustrated in FIGS. 3 and 4, wherein 2 intermediate pieces are mounted between the bases of two of the modular brush parts which are in line and the base plate of the brush.
Figure 6:
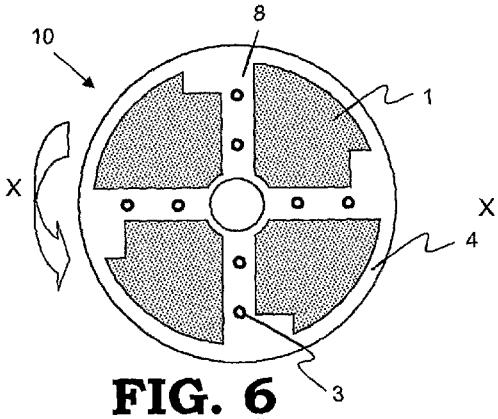
FIG. 6 shows a top view of the first embodiment of the brush as illustrated in FIGS. 1 and 2 without the modular brush parts.
Figure 7:
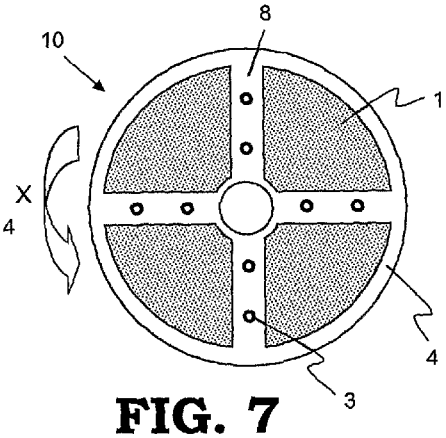
FIG. 7 shows a top view of the second embodiment of the brush as illustrated in FIGS. 3, 4 and 5 without the modular brush parts and intermediate pieces.
Figure 8:
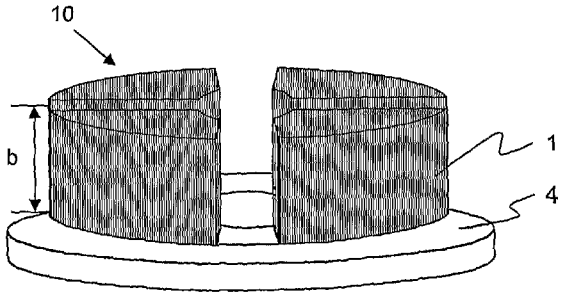
FIG. 8 shows a perspective front view of the brush without modular brush parts as illustrated in FIG. 7.
Figure 9:
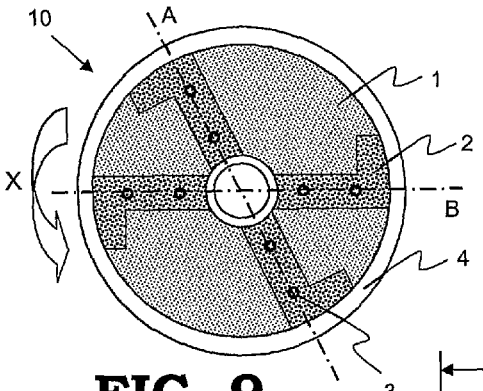
FIG. 9 shows a top view of a third embodiment of a modular brush for a machine for the horizontal and/or vertical cleaning of surfaces which are provided with grooves, joints, unevennesses and/or pores according to the invention.
Figure 10:
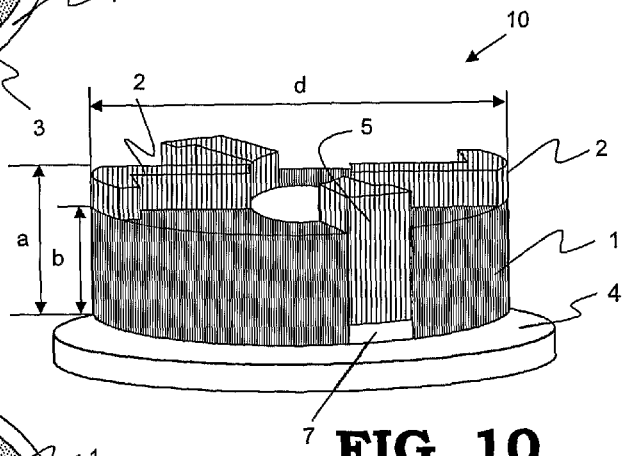
FIG. 10 shows a perspective front view of the third embodiment as illustrated in FIG. 9.
Figure 11:
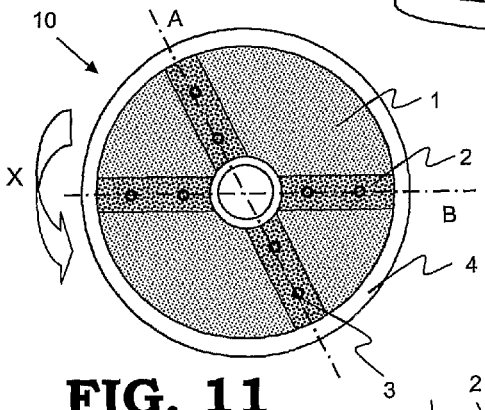
FIG. 11 shows a top view of a fourth embodiment of a modular brush for a machine for the horizontal and/or vertical cleaning of surfaces which are provided with grooves, joints, unevennesses and/or pores according to the invention.
Figure 12:
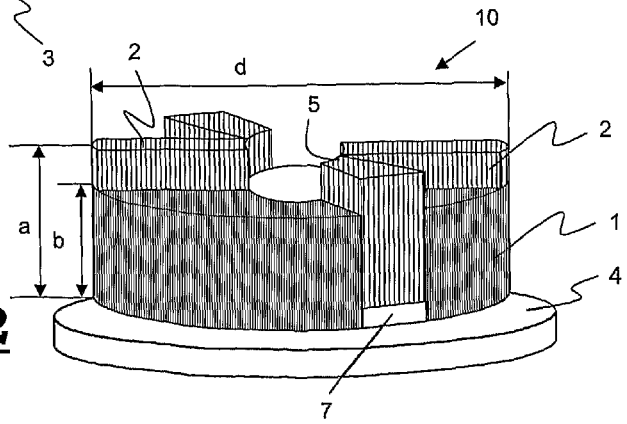
FIG. 12 shows a perspective front view of the fourth embodiment as illustrated in FIG. 11.
Figure 13:
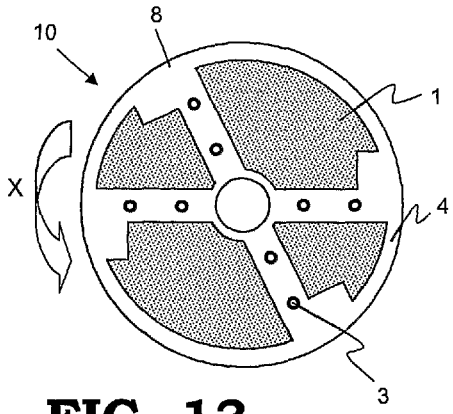
FIG. 13 shows a top view of the third embodiment of the brush as illustrated in FIGS. 9 and 10 without the modular brush parts.
Figure 14:
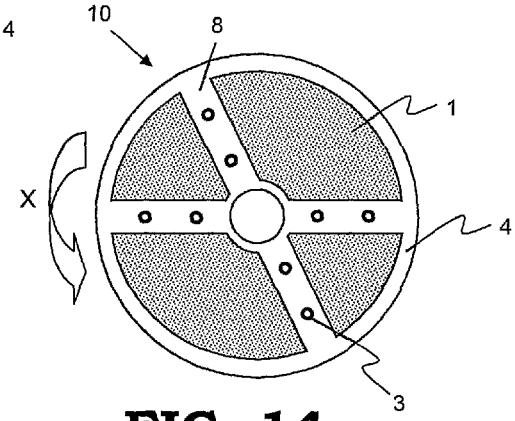
FIG. 14 shows a top view of the fourth embodiment of the brush as illustrated in FIGS. 11 and 12 without the modular brush parts.
Figure 15:
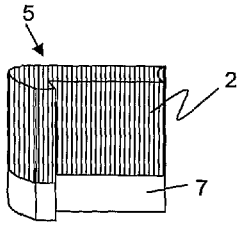
FIG. 15 shows a perspective front view of a modular brush part for the first and the third embodiment of a brush as illustrated in FIGS. 1, 2, 9 and 10.
Figure 18:
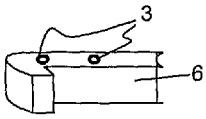
FIG. 18 shows a perspective front view of an intermediate piece which is to be mounted between a modular brush part as illustrated in FIG. 15 and a base plate of a brush as illustrated in FIGS. 1, 2, 9 and 10.
Figure 20:
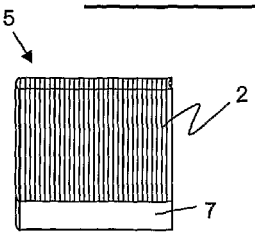
FIG. 20 shows a perspective front view of a modular brush part for the second and the fourth embodiment of a brush as illustrated in FIGS. 3, 4, 5, 11 and 12.
Figure 23:
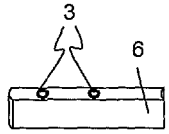
FIG. 23 shows a perspective front view of an intermediate piece which is to be mounted between a modular brush part as illustrated in FIG. 20 and a base plate of a brush as illustrated in FIGS. 3, 4, 5, 11 and 12.
Figure 16:
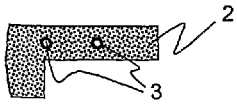
FIG. 16 shows a top view of a modular brush part as illustrated in FIG. 15.
Figure 19:
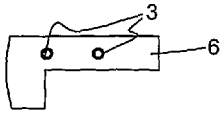
FIG. 19 shows a top view of the intermediate piece as illustrated in FIG. 18.
Figure 21:
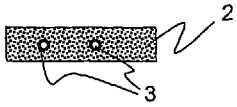
FIG. 21 shows a top view of a modular brush part as illustrated in FIG. 20.
Figure 24:
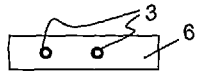
FIG. 24 shows a top view of the intermediate piece as illustrated in FIG. 23.
Figure 17:
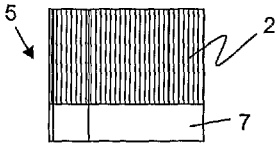
FIG. 17 shows a front view of a modular brush part as illustrated in FIG. 15.
Figure 22:
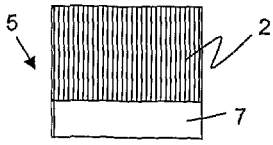
FIG. 22 shows a front view of a modular brush part as illustrated in FIG. 20.

As is illustrated in FIGS. 5 and 5A, intermediate pieces (6) (see FIGS. 18, 19, 23 and 24) may be mounted between the base plate (4) and said modular base (7) of a brush part (5).

These intermediate pieces (6) are particularly advantageous when the second hairs (2) of one or several brush parts are worn to such a degree that they no longer protrude with respect to the cleaning surface. In this way, it is not necessary to replace the entire brush part, but by inserting such an intermediate piece (6) between the modular base (7) and the base plate (4), these second hairs (2) can again protrude sufficiently with respect to the cleaning surface.

In addition, these intermediate pieces (6) are also particularly advantageous when the length by which the second hairs (2) at the cleaning surface protrude with respect to the first hairs (1) has to be different in the case of two or several of the brush parts (5) (as is illustrated in FIG. 5A), in order to be able to clean certain types of surface more effectively. Thus, such a configuration is for example very advantageous in order to efficiently remove rubber from a surface to be cleaned.

These intermediate pieces (6) therewith have the same shape as the modular brush parts (5).

As can be seen in FIGS. 6, 7, 8, 13, 14, 16, 18, 19, 21, 23 and 24, the round base plate (4) and the modular bases (7) and the intermediate pieces (6) are provided with openings (3) for attaching these modular brush parts (5) and said intermediate pieces (6) to the base plate (4). These openings (3) preferably extend through the thickness of the base plate (4), the modular bases (7) and said intermediate pieces (6) in such a manner that the releasable attachment of the brush parts (5) and the intermediate pieces (6) to the base plate (4) may be effected by means of a bolt or screw and nut connection.

The modular brush (10) according to the invention preferably has a diameter (d) which varies between approximately 5 cm up to approximately 60 cm.

The second hairs (2) preferably have a lower density (hairs/$cm^2$) and a diameter which differs from that of the first hairs (1).

The hairs (1, 2) can have a smooth or irregular surface.

The hairs (1, 2) are preferably made from plastic, more preferably from polypropylene, or from nylon or from polyester and/or from metal, preferably steel with a diameter of approximately 300 μm.

Furthermore, the cores of the hairs (1, 2) may be reinforced with reinforcing material, preferably metal wire or steel.

The composition of the hairs of the modular brush (10) is preferably as follows:

the second hairs (2) protruding with respect to the cleaning surface are made from polypropylene, nylon, polyester fibre or steel. These second hairs (2) have a length (a) which varies between approximately 4 cm and approximately 12 cm, and have a diameter which varies between approximately 0.3 mm and approximately 1.2 mm. These hairs (2) ensure that dirt, moss, grass and/or paint is removed from between the grooves, joints, unevennesses and/or pores, and in addition they clean the sides of the several surfaces which are separated from one another by means of grooves, joints, unevennesses and/or pores;

the shorter first hairs (1) are likewise made from polypropylene, nylon, polyester fibre or steel. These first hairs (1) have a length (b) which varies between approximately 3 cm and approximately 11 cm, and have a diameter which varies between approximately 0.3 mm and approximately 1.5 mm. These first hairs (1) have a good abrasive and scrubbing effect on the surfaces which are covered with dirt and/or moss.

The round base plate (4) is preferably made from plastic, more preferably from polypropylene, and has a thickness of approximately 2.5 cm.

The modular bases (7) into which the second hairs (2) are implanted are preferably made from plastic, more preferably from polypropylene, and preferably also have a thickness of approximately 20 mm. The intermediate pieces which are arranged between the base plate (4) and the modular base (7) of a brush part (5) are preferably made from plastic, more preferably from polypropylene having a thickness of approximately 10 mm.

A machine for the horizontal and/or vertical cleaning of surfaces which are provided with grooves, joints, unevennesses and/or pores may be provided with one or several such modular brushes (10) according to the invention as described above.

The operating procedure for cleaning both a horizontal and a vertical surface consisting of several surfaces, such as, inter alia, clinkers, cobblestones, natural stone, tiles, brick, external plaster, road pavement (VPA, VPAC) and/or metal and/or wood, which are separated from one another by grooves, joints, unevennesses and/or pores is as follows:

unpacking the machine, modular brushes (10), garden hose and other necessities;

fitting said modular brush(es) (10) to the machine, connecting the garden hose to the machine, turning on the water supply and switching on the machine;

rotating the modular brush(es) (10) (direction of rotation X—see FIGS. 1, 3, 6, 7, 9, 11, 13 and 14) and pushing the machine across the surface to be cleaned, as a result of which the top surface of the clinkers, cobblestones, natural stone, tiles, brick, external plaster, road pavement (VPA, VPAC) and/or metal and/or wood is cleaned;

the lateral surface of the clinkers, cobblestones, natural stone, tiles, brick, external plaster, road pavement (VPA, VPAC) and/or metal and/or wood is cleaned;

the grooves, joints, unevennesses and/or pores which are situated between the clinkers, cobblestones, natural stone, tiles, brick, external plaster, road pavement (VPA, VPAC) and/or metal and/or wood are cleaned;

at a constant speed of approximately 103 s/$m^2$. Very dirty areas are treated particularly efficiently by means of the readily manoeuvrable modular brush(es) (10) according to the invention, i.e. more or less pressure can be exerted on the modular brush(es) (10);

rinsing off the cleaned surface with the spraying device;

with clinkers, cobblestones: refilling the joints with fresh sand. This may be carried out by the same machine (scrubbing, sweeping, polishing machine), but with a brush which is provided with soft and level hairs having a length of approximately 4.5 cm. By using such a brush, the sand is pressed into the joints. Moreover, due to the sand, the clinkers, cobblestones are additionally polished, as a result of which their appearance improves further;

packing away the machine, modular brush(es) (10), garden hose and other necessities which have been used.

The invention claimed is:

1. Brush for a machine for the horizontal and/or vertical cleaning of surfaces which are provided with grooves, joints, unevennesses and/or pores, wherein said machine is provided to move the brush in a plane which is substantially parallel to said surface, and wherein this brush is provided with at least one set of first hairs for cleaning or polishing the parts of the surface which extend between the grooves, joints, unevennesses and/or pores, at least one set of second hairs for cleaning the grooves, joints, unevennesses and/or pores;

wherein these first and second hairs form a cleaning surface and wherein these second hairs protrude with respect to the first hairs at this cleaning surface, wherein the brush comprises a base plate which is provided to be releasably attached by means of one or several bolt or screw connections to one or several brush parts which are provided with one or several of the sets of second hairs, whereby said base plate comprises two or several of the sets of first hairs which are directly planted into the base plate, wherein there is a zone between two of the sets of first hairs which is free from said first hairs and which is provided for releasably attaching said brush parts wherein said second hairs are implanted.

2. Brush according to claim 1, characterized in that the zones which are provided for the attachment of said brush parts have a shape which is complementary to the shape of the zones wherein said two or several sets of first hairs extend.

3. Brush according to claim 1, characterized in that one or several intermediate pieces are provided to be mounted between the base plate and said brush part.

4. Brush according to claim 3, characterized in that said base plate, brush parts and intermediate pieces are provided with one or several openings which extend through the thickness of the base plate, brush parts and intermediate pieces in order to releasably connect the brush parts and the intermediate pieces to the base plate by means of a bolt or screw and nut connection.

5. Brush according to claim 1, characterized in that the second hairs of at least two of said brush parts protrude over a different length with respect to the said first hairs at the level of said cleaning surface.

6. Brush according to claim 1, characterized in that said brush parts are provided with different types of second hairs.

7. Brush according to claim 1, characterized in that said brush parts are L-shaped.

8. Brush according to claim 1, characterized in that the brush comprises four of said brush parts which are arranged in pairs in line with respect to one another in the assembled state of the brush.

9. Brush according to claim 8, characterized in that the fictitious lines on which the brush parts are situated in the assembled state are at an angle of approximately 90°.

10. Brush according to claim 1, characterized in that the base plate is of a round design.

11. Brush according to claim 1, characterized in that the second hairs have a lower density than the first hairs.

12. Brush according to claim 1, characterized in that the second hairs have a diameter which differs from the diameter of the first hairs.

13. Brush according to claim 1, characterized in that one or several first and/or second hairs have a smooth surface.

14. Brush according to claim 1, characterized in that one or several first and/or second hairs have an irregular surface.

15. Brush according to claim 1, characterized in that the hairs are made from plastic and/or metal.

16. Brush according to claim 1, characterized in that the cores of the first and/or second hairs are reinforced with reinforcing material.

17. Brush according to claim 16, characterized in that the cores of the first and/or second hairs are reinforced by means of metal wire or steel.

18. Brush according to claim 3, characterized in that the base plate, the brush parts and the intermediate pieces are made from plastic.

19. Machine for the horizontal and/or vertical cleaning of surfaces which are provided with grooves, joints, unevennesses and/or pores, wherein said machine is provided with at least one brush which is moved in a plane which is substantially parallel to said surface, and wherein this brush is provided with at least one set of first hairs for cleaning or polishing the parts of the surface which extend between the grooves, joints, unevennesses and/or pores, at least one set of second hairs for cleaning the grooves, joints, unevennesses and/or pores;

wherein these first and second hairs form a cleaning surface and wherein these second hairs protrude with respect to the first hairs at this cleaning surface, wherein the brush comprises a base plate which is provided to be releasably attached by means of one or several bolt or screw connections to one or several brush parts which are provided with one or several of the sets of second hairs, whereby said base comprises two or several of the sets of first hairs which are directly implanted into the base plate, wherein there is a zone between two of the sets of first hairs which is free from said first hairs and which is provided for releasably attaching said brush parts wherein said second hairs are implanted.

20. Brush according to claim 18, characterized in that the base plate, the brush parts and the intermediate pieces are made from polypropylene.

* * * * *